United States Patent [19]

Brotz

[11] Patent Number: 4,761,010

[45] Date of Patent: Aug. 2, 1988

[54] BOARD GAME

[76] Inventor: Gregory R. Brotz, P.O. Box 1322, Sheboygan, Wis. 53081

[21] Appl. No.: 848,627

[22] Filed: Apr. 7, 1986

[51] Int. Cl.[4] ..... A63F 3/00

[52] U.S. Cl. ..... 273/275; 273/261; 273/242

[58] Field of Search ..... 273/275, 261, 242, 236; 434/188, 195

[56] References Cited

U.S. PATENT DOCUMENTS 2,776,835 1/1957 Wilson ..... 446/2 X 3,315,404 4/1967 Rosen ..... 446/2

3,730,527 5/1973 Nelson ..... 273/261 X 4,248,433 2/1981 Soriano ..... 446/2 X

FOREIGN PATENT DOCUMENTS 2055589 3/1981 United Kingdom ..... 273/261

*Primary Examiner*—Joseph Falk

*Attorney, Agent, or Firm*—William Nitkin

[57] ABSTRACT

A game of serial falling playing pieces with a game board having a plurality of rows of game spaces thereon of varying configuration with a plurality of game pieces for positioning on said game board.

9 Claims, 7 Drawing Sheets

BOARD GAME

BACKGROUND OF THE INVENTION

1. Field of the Invention

The apparatus of this invention is a board game and more particularly relates to a game having successively toppling game pieces arrayed on a game board.

2. Description of the Prior Art

The experience of toppling rows of dominoes has long been known and enjoyed by those who arrange such domino chains in various patterns and designs. Chain reaction toppling of dominoes or other pieces has been used in games played on game boards such as disclosed in U.S. Pat. No. 2,776,835 to R. C. Wilson entitled Racing Game Apparatus. In this patent a game board is provided with an arrangement of sockets on twisted paths into which rectangular playing pieces or tumblers are inserted per the rules of the game and at some point in the play in order to win the game, the pieces are toppled in a chain reaction from the starting gate to the finish line. Another game employing toppling game pieces is found in U.S. Pat. No. 3,315,404 to L. B. Rosen entitled Game Employing Successively Toppling Game Pieces. In this game dominoes are utilized going up and down steps forming bridges and then moving pivotal gates in order to knock down another row of dominoes going up and down such steps. Another game employing toppling game pieces found in the prior art is disclosed in U.S. Pat. No. 4,248,433 to Soriano entitled Chain Reaction Falling Playing Pieces Board Game. In this game hexagonal configured toppling pieces are inserted in a selected direction within an indented playing cell in a hexagonal arrangement on the board. Each playing cell has a series of rectangular slots in which the piece can be positioned in any one of the directions parallel to a side of the cell's hexagonal shape so that when the piece falls, it will fall in the desired direction.

SUMMARY OF THE INVENTION

It is an object of this invention to provide a new form for a board game to be used by two or more players employing toppling game pieces such as dominoes and the like. The game of this invention is designed to require a high degree of skill and strategic planning in the placement of the game pieces on the game board so as to effect a winning chain reaction.

When players start a new game, it is expected that they will begin forming chains of game pieces directly across from one another at each at their own base line. One or more game pieces are placed on spaces on the game board by a player when it is his turn, the number of spaces being designated by chance selection of such number such as determined by the roll of a die or by other random number generating device.

The game board is generally rectangular and has on it a pattern of spaces in which the game pieces each must be placed. The arrangement of this pattern is critical to the playing of the game. The game board of this invention can have many arrangements including logarithmic narrowing of the spaces on which the game pieces are placed. The logarithmic construction of the spaces on some of the game boards allows a player when he reaches a place of wide spaces to start lateral or diagonal chains which are most advantageous, but a player must be cautious because soon he will encounter the portions of the game board having smaller spacing where the chains become limited in their lateral and diagonal direction. The game board can have a central horizontal dividing line to designate one player's side from another and a base line for each player from which play originates.

The strategies utilized by the players in this game are both offensive and defensive. Players can start offensive and defensive chains at any time. At some point during a game it might be advantageous for a number of playing pieces determined by whatever random number generating device is utilized to be removed rather than added to a player's chain should that player wish to retreat from an unsafe position on the game board for example when his opponent has an opportunity to interrupt his chain. In some games a player, instead of removing a certain number of playing pieces to avoid an unsafe position, can take that number of playing pieces and move them from one position to another on the game board. A player is allowed to use another player's playing pieces for his own benefit in forming a chain. In some games variations can be provided where the players can complete chains across the board by intersecting a competitor's chain at a place other than the end or last playing piece and utilize segments of a competitor's chain to form his own chain reaction. A player might wish to skip spaces on the board where two non-adjacent spaces are so close that the player feels that he can make a chain reaction occur between two dominoes on those spaces. Further, the game can impart the strategy of blocking which can be done when a domino is placed perpendicular to the face of a competitor's playing piece, but it is felt that at least in some rules that a perpendicular blocking placement could not be utilized unless the player making it could use that playing piece in his own chain reaction.

A chain reaction may either win the game for a player or be counted as points toward the final score of the game. Some games may limit the chains to prevent splitting and other games may be scored based on the length of the chain, which method of scoring would make it advantageous to form circuitous chain designs. In some scoring systems, if a chain reaction is attempted but fails to move from one side of the board to the other, the number of stillstanding playing pieces can be deducted from the total score or the total number of playing pieces attempted to cause to topple can be deducted.

In other embodiments of the game of this invention, a computer as a playing opponent can be incorporated to generate moves signaled by lights under particular spaces under a board which would light up to show where the computer wished to place its game piece(s). In other embodiments the game board can have elevations or other three-dimensional placements or devices on the board which can add further interest to the game. Some game boards can utilize circular positioning areas with each player having a choice of several positions in which to place his game pieces such as on positions parallel to the direction of pay or behind positioned 90 degrees to it or at 45 degree angles from either. In a further embodiment, the game spaces can be arranged so that the boundaries of the next adjacent space bisects the center of the previous space which arrangement would make it easier to produce forking in the formation of domino chains.

DESCRIPTION OF THE PREFERRED EMBODIMENT(S)

Figure 1:
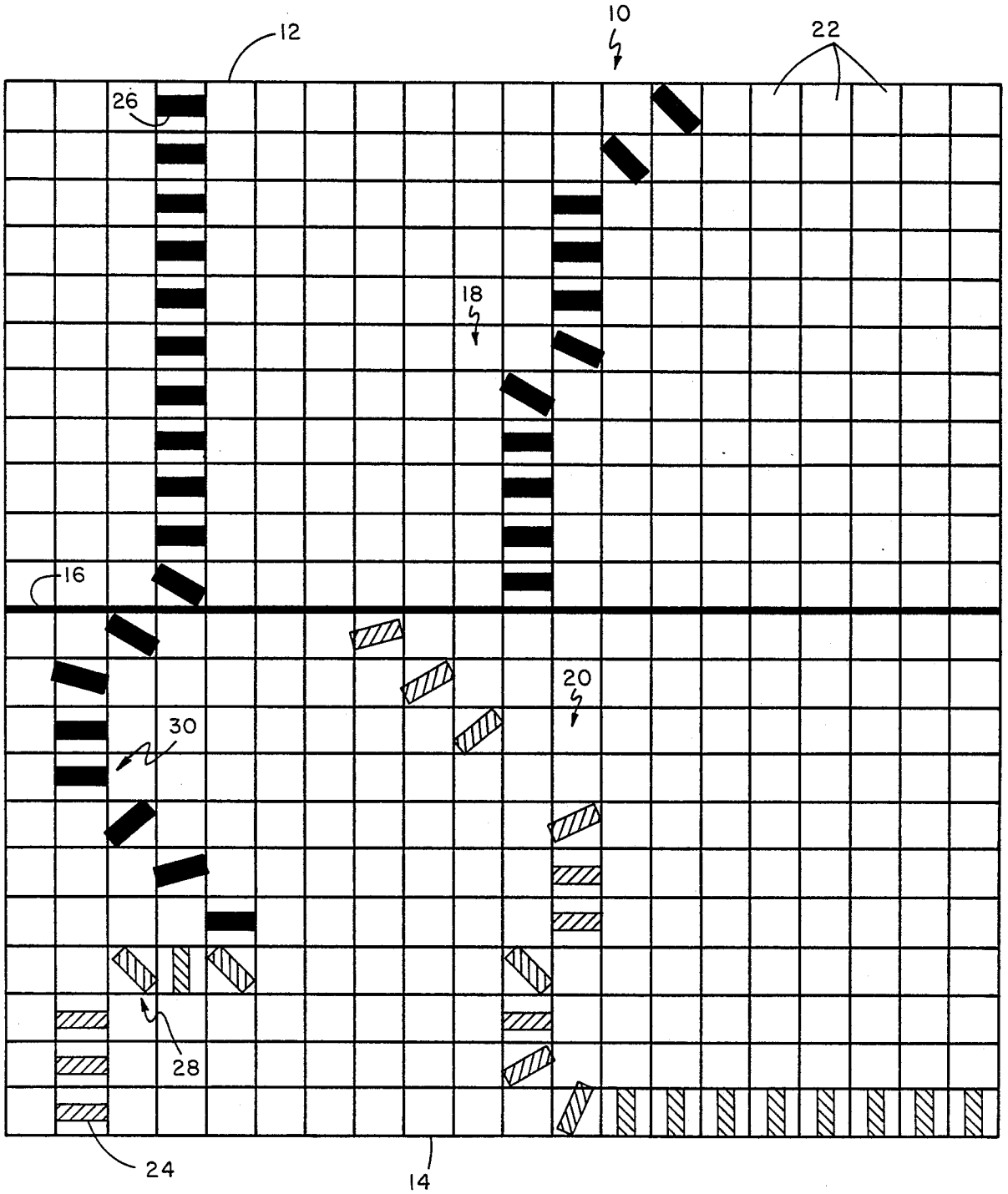
FIG. 1 illustrates a game board having rectangular spaces all of the same size with some game pieces thereon.

FIG. 1 illustrates a typical game board 10 of this invention with base lines 12 and 14 at opposite ends and center line 16 denoting playing zones 18 and 20 respectively of each player. Game spaces 22 are rectangular and game pieces 24 and 26 of each player are denoted by different shading and are started respectively from base lines 12 and 14 and extend toward the opposing player's base line. The first player to form a chain from his base line to his opponent's base line which he can successfully topple scores a win or points toward a win. As can be seen in the embodiment illustrated in FIG. 1, various degrees of angular positioning of the game pieces are allowable within game spaces 22 thereby allowing for lateral and diagonal positioning of the pieces so that chains snaking over the game board can be formed as either defensive or offensive maneuvers. For example, extending from base line 14 is short chain 28 of game pieces which may block long chain 30 of the other player, and the toppling chain may or may not be successful depending on the careful placement and strategy employed by each player.

Figure 2:
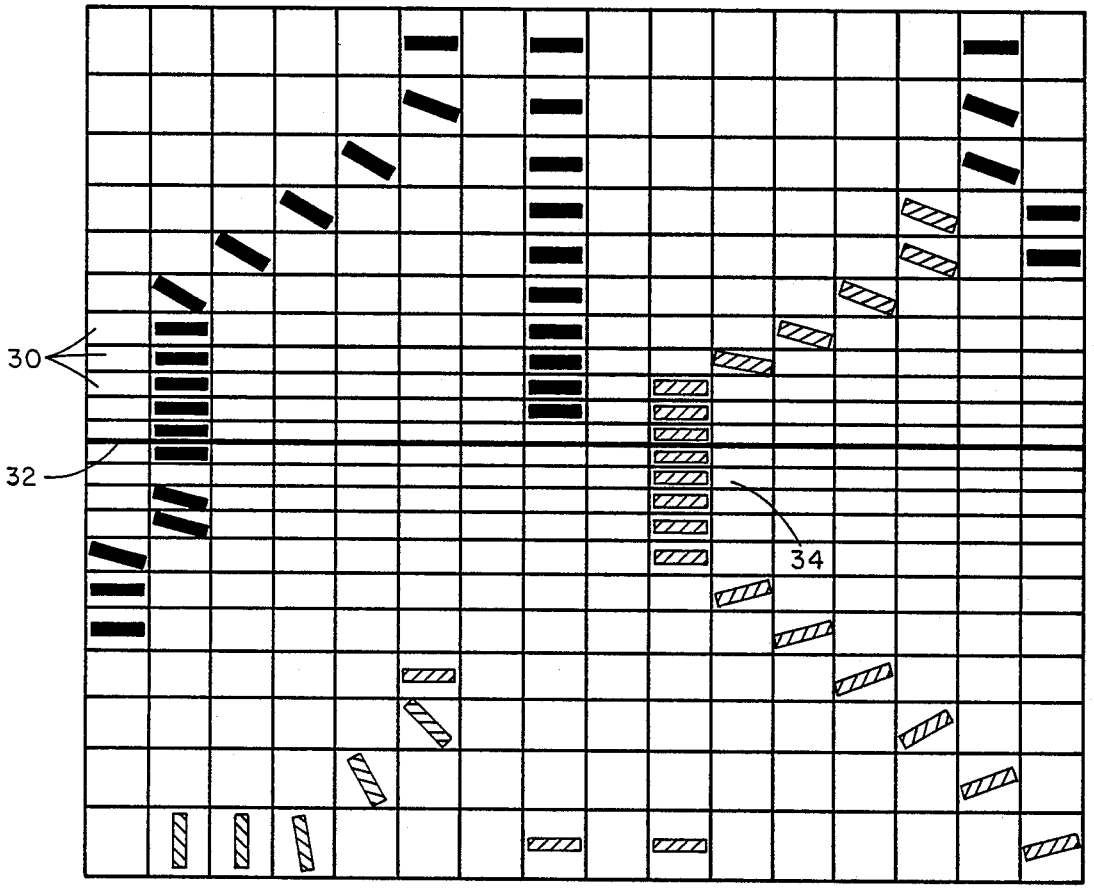
FIG. 2 illustrates a game board having a logarithmic narrowing of the spaces near the center line thereof.

FIG. 2 illustrates the game board of this invention having narrowing logarithmic game spaces 30 near center line 32 thereof. In this version while the game pieces can be positioned angularly within the game spaces near each base line, as they approach the center line, game pieces 34 are positioned so that they are parallel to the base line and less and less maneuvering near the center of the game board is possible and strategy in the placement of pieces must be employed.

Figure 3:
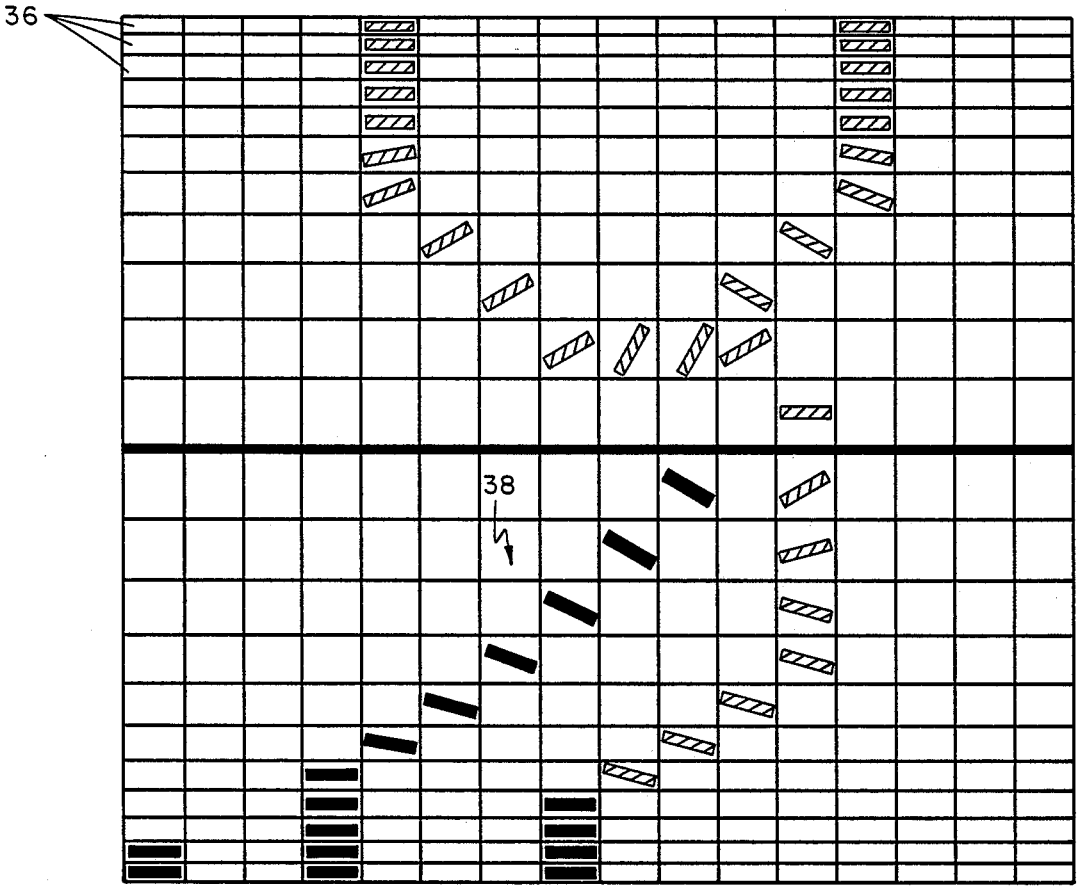
FIG. 3 illustrates a game board having a logarithmic narrowing of the spaces near the base line thereof.

FIG. 3 illustrates a game board where the logarithmic narrowing of game spacs 36 is near each base line. Thus the first game pieces can only be positioned generally parallel to the base line as each player starts but as each player progresses toward the center line, the playing spaces get larger and the pieces can be placed in a more diagonal position 38 for lateral or diagonal movement before one's chain moves toward the opposing player's base line where the game pieces are again restricted in their positioning by the narrow smaller size of the base line game spaces.

Figure 4:
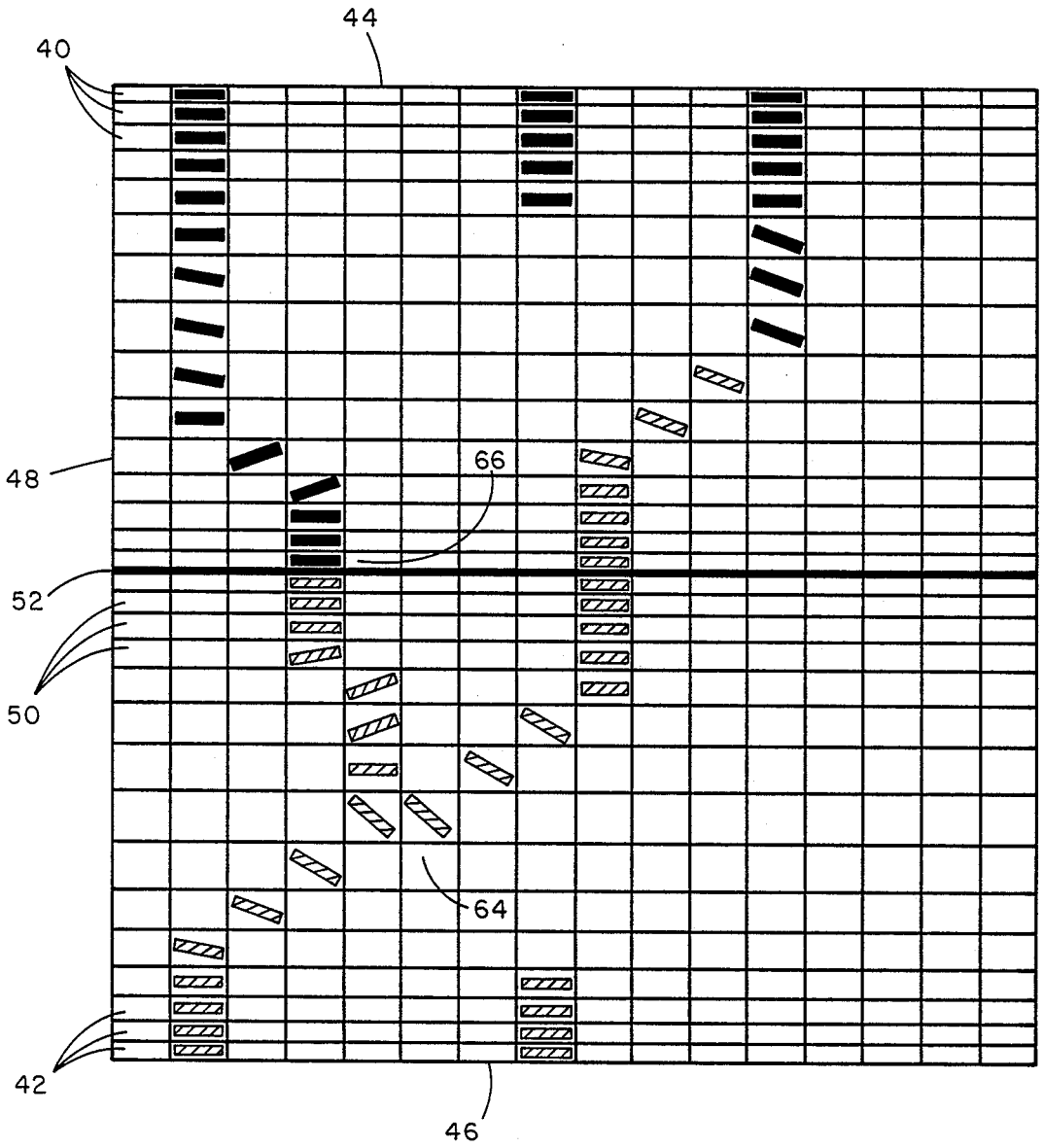
FIG. 4 illustrates a game board having a logarithmic narrowing of the spaces near both the base line and center line thereof.

FIG. 4 illustrates the embodiment of the game board wherein the logarithmic narrowing of the game spaces 40 and 42 occurs at both base lines and near each side 48 and 50 of center line 52. This design allows only for diagonal positioning 64 near the center of each player's side of the board so that positioning of the game pieces must be carefully considered in order to have one's chain of game pieces cross the center line without being blocked by an opponent's pieces which blocking can be seen at point 66. considerable strategy must be employed by players utilizing this version of the game board.

Figure 5:
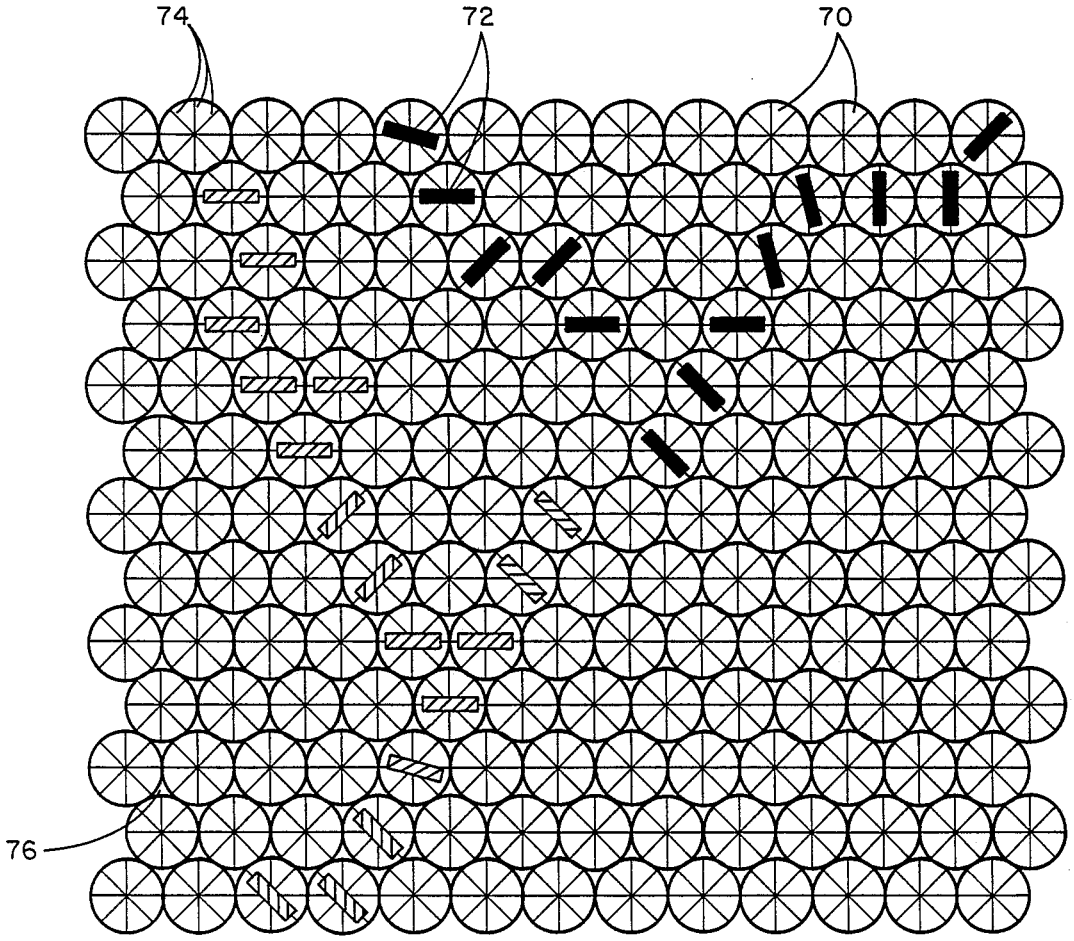
FIG. 5 illustrates a game board having multi-directional indicia thereon for angular placement of game pieces.
Figure 6:
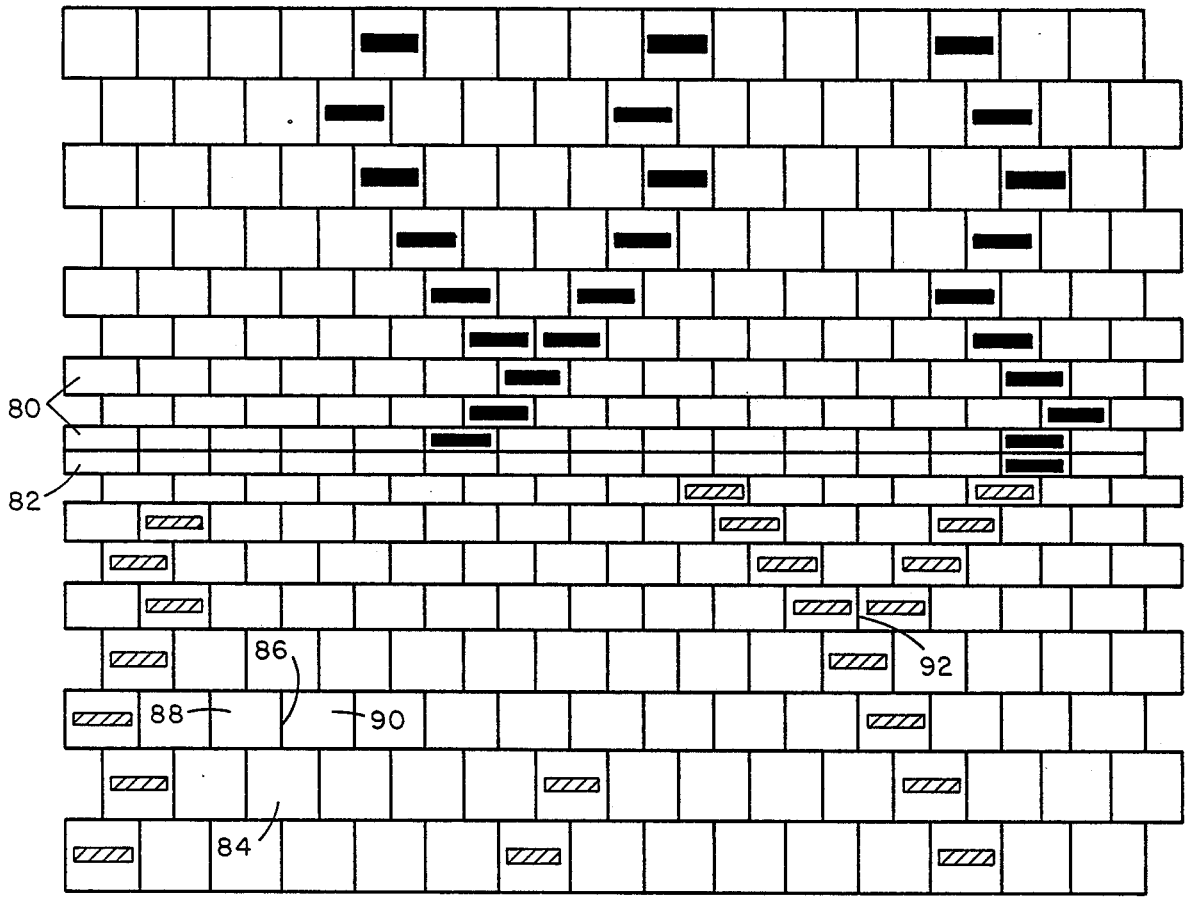
FIG. 6 illustrates a game board having a logarithmic narrowing of the spaces near the center line thereof with rows of spaces being offset so that adjoining rows of spaces are positioned so that each space's center is at the dividing line of the spaces of the adjacent row.
Figure 7:
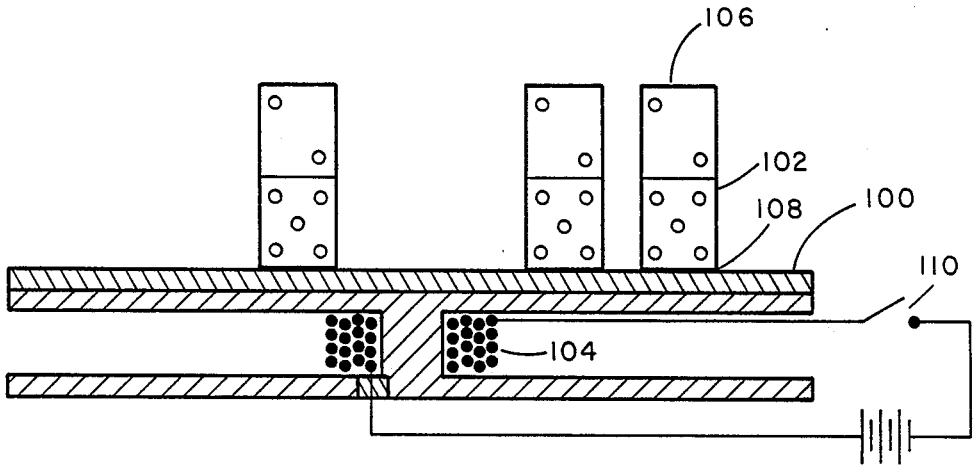
FIG. 7 illustrates a cross-sectional view of a game board of this invention utilizing magnetic attraction to hold the game pieces in place during their positioning.

In FIG. 5 an embodiment of the game utilizing a game board having circular game spaces 70 arrayed on a rectangular board is illustrated whereby game pieces 72 can be positioned within each circle along lines 74 in directions, for example, 45 degrees from one another, parallel to the base line, perpendicular to the base line, or at other angles thereto depending upon one's chain-building strategy. Chains can be easily formed because each row of circles is offset so that the next row of circles is positioned with each circle adjacent to two adjacent circles 76. This same offset positioning of the game spaces can be formed on a rectangular board as illustrated in FIG. 6 where the logarithmic narrowing 80 of the board is found near center line 82, but each game space 84 is positioned adjacent to dividing line 86 of game spaces 88 and 90 above and below it and therefore a playing piece positioned further toward the base line, if toppling, would pass through two spaces. The design of this game board allows for the formation of bisecting Y-shaped chains 92 which chains further increase the strategy required to play the game successfully.

In some embodiments the game board can have a magnetizable surface such as metal surface 100 or equivalent under which is disposed an electromagnet 104. At the ends of each game piece 102 can be metal strips 106 and 108 although the game pieces can be adapted in equivalent ways to be attachable to a magnetic field. When electromagnet 104 is turned on at a switch 110, the game pieces are securely held by magnetic attraction to where they are positioned on the game board and cannot be inadvertently knocked over. When a player desires to attempt to knock down a chain of game pieces, he would first shut off electromagnet 104 by switch 110 thereby eliminating the holding force of the electromagnetic field to the game pieces so that they would then be free to fall.

Although the present invention has been described with reference to particular embodiments, it will be apparent to those skilled in the art that variations and modifications can be substituted therefor without departing from the principles and spirit of the invention.

I claim:

1. A game of serial falling playing pieces for two or more players having a game board, comprising:

a plurality of rectangular game pieces, said game pieces each having the same height, width and depth as one another, said width and depth determining the size of the top and bottom of said game piece;

a rectangular game board surface having a plurality of parallel rows of rectangular game spaces thereon, each game space having two horizontal sides parallel to said rows and two vertical sides perpendicular to said rows, said game spaces forming two sides on said board, each side bounded by a base line parallel to said rows and a common center line parallel to said rows, each of said game spaces being at least the size of the bottom of one of said game pieces which can only be positioned exactly thereon within the boundaries of said game space with its width parallel to said base line and center line with selected of said game spaces being of a size larger than the bottom of one of said game pieces allowing said game piece to be set on its bottom in said larger game piece space with its width in a variety of angular positions to said center line, said game piece's height being great enough to extend across any two adjacent game spaces, said game pieces to be alternately positioned by each player in turn on its bottom on a game space, each game piece placing facing in a player-selected direction to form a chain line of game pieces in a continuous line extending from a player's base line across the board to the opposing player's base line for toppling from one player's base line to the opposing player's base line in a chain reaction when said chain line of game pieces is completed; and wherein said game spaces near said center line are formed progressively smaller in each row from said base line toward said center line, each smaller space limiting the possible angular positioning thereon of said game pieces and wherein near said center line each of said game spaces is the size of said game piece's bottom and where no angular positioning of a game piece is possible.

2. The game of claim 1 wherein the vertical sides of said game spaces in a row bisect the horizontal sides of said game spaces of the adjoining rows of game spaces, said game board allowing for Y-shaped chain lines of game pieces to be formed.

3. The game of claim 1 further including:

a magnetizable game board adapted to be selectively in an on mode when said game pieces are being positioned on said game board and in an off mode when said game pieces are desired to fall; and wherein each of said plurality of game pieces includes means adapted to be attracted to said magnetic game board when said game board is in its on mode.

4. A game of serial falling playing pieces for two or more players having a game board, comprising:

a plurality of rectagular game pieces, said game pieces each having the same height, width and depth as one another, said width and depth determining the size of the top and bottom of said game piece;

a rectangular game board surface having a plurality of parallel rows of rectangular game spaces thereon, each game space having two horizontal sides parallel to said rows and two vertical sides perpendicular to said rows, said game spaces forming two sides on said board, each side bounded by a base line parallel to said rows and a common center line parallel to said rows, each of said game spaces being at least the size of the bottom of one of said game pieces which can only be positioned exactly thereon within the boundaries of said game space with its width parallel to said base line and center line with selected of said game spaces being of a size larger than the bottom of one of said game pieces allowing said game piece to be set on its bottom in said larger game piece space with its width in a variety of angular positions to said center line, said game piece's height being great enough to extend across any two adjacent game spaces, said game pieces to be alternately positioned by each player in turn on its bottom on a game space, each game piece placed facing in a player-selected direction to form a chain line of game pieces in a continuous line extending from a player's base line across the board to the opposing player's base line for toppling from one player's base line to the opposing player's base line in a chain reaction when said chain line of game pieces is completed; and wherein said rows of game spaces are arrayed from said center line to each of said base lines, said game spaces in said rows growing successively larger in the direction from said base lines to said center line, so that the bottoms of said game pieces can be positioned in said game spaces at various angles near said center line but are limited in angular positioning by the smaller size of the game spaces near said base lines.

5. The game of claim 4 wherein the vertical sides of said game spaces in a row bisect the horizontal sides of said game spaces of the adjoining rows of game spaces, said game board allowing for Y-shaped chain lines of game pieces to be formed.

6. The game of claim 4 further including:

a magnetizable game board adapted to be in an on mode when said game pieces are being positioned on said game board and in an off mode when said game pieces are desired to fall; and wherein each of said plurality of game pieces includes means adapted to be attracted to said magnetic game board when said game board, is in its on mode.

7. A game of serial falling playing pieces for two or more players having a game board, comprising:

a plurality of rectangular game pieces, said game pieces each having the same height, width and depth as one another, said width and depth determining the size of the top and bottom of said game piece;

a rectangular game board surface having a plurality of parallel rows of rectangular game spaces thereon, each game space having two horizontal sides parallel to said rows and two vertical sides perpendicular to said rows, said game spaces forming two sides on said board, each side bounded by a base line parallel to said rows and a common center line parallel to said rows, each of said game spaces being at least the size of the bottom of one of said game pieces which can only be positioned exactly thereon within the boundaries of said game space with its width parallel to said base line and center line with selected of said game spaces being of a size larger than the bottom of one of said game pieces allowing said game piece to be set on its bottom in said larger game piece space with its width in a variety of angular positions to said center line, said game piece's height being great enough to extend across any two adjacent game spaces, said game pieces to be alternately positioned by each player in turn on its bottom on a game space, each game piece placed facing in a player-selected direction to form a chain line of game pieces in a continuous line extending from a player's base line across the board to the opposing player's base line for toppling from one player's base line to the opposing player's base line in a chain reaction when said chain line of game pieces is completed; and wherein said game spaces are of the size of the bottoms of said game spaces near said base lines and near said center line thereby limiting the angular positioning of game pieces near said base lines and said center line and wherein said game spaces are larger in the middle rows on each side of said game board to allow for angular game piece positioning therein.

8. The game of claim 7 wherein the vertical sides of said game spaces in a row bisect the horizontal sides of said game spaces of the adjoining rows of game spaces, said game board allowing for Y-shaped chain lines of game pieces to be formed.

9. The game of claim 7 further including:

a magnetizable game board adapted to be in an on mode when said game pieces are being positioned on said game board and in an off mode when said game pieces are desired to fall; and wherein each of said plurality of game pieces includes means adapted to be attracted to said magnetic game board when said game board is in its on mode.

* * * * *